United States Patent [19]

Gustafson

[11] 4,261,149

[45] Apr. 14, 1981

[54] MOBILE HOME SUPPORT SYSTEM

[76] Inventor: Harold L. Gustafson, 19304 NE. 112th Ave., Battle Ground, Wash. 98604

[21] Appl. No.: 59,323

[22] Filed: Jul. 20, 1979

[51] Int. Cl.[3] ..... E04B 5/43; E02D 27/00

[52] U.S. Cl. ..... 52/292; 52/657; 52/695; 52/DIG. 11

[58] Field of Search ..... 52/122, 126, 262, 263, 52/292, 299, DIG. 3, DIG. 11, 657

[56] References Cited

U.S. PATENT DOCUMENTS

| | | | |
|---|---|---|---|
| 1,678,971 | 7/1928 | Bergesen | 52/263 |
| 3,606,704 | 9/1971 | Denton | 52/126 |
| 3,704,560 | 12/1972 | Ratliff | 52/126 |
| 3,713,259 | 1/1973 | Tkach | 52/126 |
| 4,064,668 | 12/1977 | Carter | 52/263 |

FOREIGN PATENT DOCUMENTS

| | | | |
|---|---|---|---|
| 570980 | 12/1957 | Italy | 52/299 |

*Primary Examiner*—James L. Ridgill, Jr.
*Attorney, Agent, or Firm*—Daniel J. Meaney, Jr.

[57] ABSTRACT

A support system for mobile home having a chassis formed of a plurality of spaced, parallel support beams having an "I"-shaped cross section comprising a plurality of support member assemblies each of which has a planar base, a vertically extending portion having a predetermined external dimension and shape, aligned base tabs which extend from the vertically extended support member and spaced a predetermined distance from the vertically extending portion of the base, an adjustment ring which has an internal dimension and shape to enable the ring to be slideably positioned circumferentially around the exterior of the vertically extending portion of the base wherein the wall thickness of the ring is about equal to the distance between the vertically extending portion of the base and tab members; a top member which has an extended lower portion formed to have an internal geometrical dimension which is shaped to receive and slide over the vertically extending portion of the base and into contact with the edge of the ring and wherein the top member includes a stabilizing plate and a gripping means to attach the stabilizing plate to a flange of the "I"-shaped beams and a pair of aligned top tabs which are positioned on each side of the extended lower portion of the top member in substantially the same position in alignment with the base tabs and a plurality of strut stabilizing rods having one end which extends from the top tabs and the bottom tabs and to another support member assembly or a strut stabilizing rod connecting device clamped to the same "I"-shaped beam is shown.

12 Claims, 9 Drawing Figures

MOBILE HOME SUPPORT SYSTEM

BACKGROUND OF THE INVENTION

1. Field of the Invention

This invention relates to a mobile home support system and more particularly to a support structure having a plurality of height adjustable support member assemblies comprising a planar base with a vertically extending member, a height adjusting ring and top member having a gripping means for connection to an "I"-shaped beam forming a mobile home chassis and which cooperate with a plurality of strut stabilizing rods to provide a rigid support system for a mobile home. The support system is capable of supporting a mobile home during an earthquake or other similar jarring forces.

2. Disclosure of the Prior Art

It is known in the prior art to provide a support system for a mobile home. Typically, a standard mobile home has a chassis which is formed of a plurality of spaced parallel support beams having an "I"-shaped cross section. The mobile home is generally supported by a plurality of axles which are positioned in approximately the center of the mobile home to permit transporting thereof. A mobile home is installed or set up in a permanent location by providing supports, jacks or a foundation around the periphery and center of the mobile home.

In certain known prior art installation systems, the supports are formed of blocks or other similar supports which rely solely upon the compressional force of the mobile home to hold the mobile home in place on a concrete or similar pad.

One known prior art support system is disclosed in U.S. Pat. No. 4,064,668 which makes use of a support member which is anchored in concrete. The anchored support is attached, through an adjustable member, to the frame of a mobile home. A turnbuckle is used as the adjustable member to maintain a rigid support between the mobile home chassis and the anchored support member.

In substance, the known prior art support systems for a mobile home comprise a support member which serves as a separate foundation to support the mobile home, but which permits movement of the mobile home relative to both the separate support members and the ground. Thus, shifting of the mobile home relative to the support and ground generally results in the support being shifted from under the mobile home, thereby causing the mobile home to tip, jolt or otherwise shift off of the support.

In the event of an earthquake which results in a natural seismic wave, relative movement occurs between the mobile home, the support system and the ground, which enables the support system to be broken away from or lose its contact with the mobile home, thereby resulting in loss of support of the mobile home.

The support systems which utilize an anchored member which is rigidly attached to the chassis of the mobile home must provide a restraining force which is sufficient in magnitude to overcome any earthquake or other similar force.

It is also known in the prior art to utilize a support system wherein supports are actually directly welded to the bottom of the mobile home chassis to provide a movable support system. However, this requires construction of a specific type of foundation and/or support system which is customed to the specific mobile home involved, and each support length must be cut to size. Relative movement will occur between the mobile home and the earth during an earthquake, and the support system, when welded to the "I"-shaped beam, would likewise remain part of a move with the mobile home.

SUMMARY OF THE INVENTION

In accordance with the teachings of the present invention, these is provided a novel and unique mobile home support system which comprises a plurality of removable support member assemblies each of which is adapted to be removably attached to a mobile home having a chassis formed of a plurality of spaced, parallel "I"-shaped beams to enable the setting up and subsequent removal and moving of a mobile home from one site to a second site.

Specifically, the support system for a mobile home comprises a plurality of support member assemblies each of which has a planar base, a vertically extending portion having a selected external geometrical dimension and shape which is adapted to receive a top member which has an extended lower portion which is formed of an internal geometrical dimension and shape to receive and slide over the vertically extending portion of the base. An adjusting ring, having an external geometrical dimension and shape is adapted to be positioned circumferentially around the exterior of the vertically extending portion. If necessary, due to the height of the vertically extending portion being short, an adjusting ring may be used as a means for selecting the exact height required to support the mobile home relative to the ground. The exact height is obtained by selecting a ring having a preselected axially extended length. The support member and the top member each has a plurality of extended tabs which are adapted to be connected to and cooperate with a plurality of strut stabilizing rods. The strut stabilizing rods are adapted to extend between support member assemblies at the ends of the mobile home and are adapted to be attached to strut stabilizing rod connecting members along the side of the mobile home to provide a rigid support system therefor. By use of the support member assemblies and strut stabilizing rods at the end of the mobile home and use of the support member assemblies with the strut stabilizing rods and intermediate strut stabilizing rod connecting member attached to the chassis support beam, a rigid movable support system for the mobile home is provided by this invention. In the event of ground movement relative to the mobile home, the support system, which is integral with the chassis and the mobile home, will move relative to the ground due to the integral assembly of the mobile home and the mobile home support system.

In the event of undulations of earth which are encountered in an earthquake, the entire support system and mobile home itself will be moved relative to the undulating earth. By use of this invention, support of the mobile home is not lost at any time during an earthquake. The entire mobile home and support system will remain intact and move as an integral unit which would then resettle back onto the earth after the passage of the seismic wave from an earthquake.

In the known prior art systems, during an earthquake, relative movement would occur between the undulating ground, the mobile home and support member. Thus, the mobile home moves relative to both the foundation and undulating earth which causes loss of support resulting in the mobile home being tilted, rotated about the tires, or otherwise damaged due to the support member or foundation actually penetrating the floor of the mobile home. This necessitates the reinstallation of the mobile home, and the reconstruction or repair of the foundation and damaged mobile home.

In the known prior art support system using an anchored support member, it is necessary to provide each installation with its own concrete anchored support member which may or may not be disturbed during an earthquake due to the magnitude thereof. In the event that the magnitude of the earthquake is such that the tension or shear force is greater than that of the anchored support member or turnbuckle, the strength of the turnbuckle or other support members must be sufficient to overcome earthquake forces and actually restrain the entire mobile home during an earthquake. In the event that the earthquake is of a large magnitude and/or provides large undulations of earth movement, it is possible for one end of the mobile home and support system to be moved relative to the other end which would cause severe strain and twisting due to the mobile home being restrained in position.

In the preferred embodiment of the present invention, the support member assemblies are adapted to be a standard element which can be located at any position on the mobile home. By use of the support member and top member, either alone or with an adjusting ring, a support foundation of an exact length can be provided. The top member is clamped to and joined to the "I"-shaped beam by means of gripping means. The support member assemblies are interconnected by means of a plurality of strut stabilizing rods. Specifically, at each end of the mobile home, a rigid integral support assembly is formed by "X"-shaped strut stabilizing rods. Along the axial length or side of the mobile home, the support member assemblies, strut stabilizing rods and strut stabilizing rod connecting device for supporting the strut stabilizing rods are located intermediate of the support member assemblies. Thus, the entire mobile home, chassis and support system are formed into an integral unit which is capable of moving relative to the earth in the event of undulations of the earth or other earth movement.

One advantage of the present invention is that the mobile home support system is adapted to form an integral unit with a mobile home such that, during earth movements, any shifting or sliding results in relative movement occurring only between the support system which is integral with a mobile home and the earth.

Another advantage of the present invention is that a plurality of standard support member assemblies can be used as a foundation and support around the exterior of the mobile home and center support to allow for easier setup, installation or de-installation of the mobile home. The exact height required to support the mobile home relative to the ground can be obtained by use of adjusting rings of selected axial lengths.

Yet a further advantage of the present invention is that a standard support member assembly having a base, top member and an adjusting ring can be used to form individual supports and uniform length strut stabilizing rods can be utilized to interconnect the support member assemblies at the ends of the mobile home and with a strut stabilizing rod connecting device attached to the "I"-shaped beams forming the chassis of the mobile home along the lengths thereof.

Yet another advantage of the present invention is that the top member includes a stabilizing plate which is adapted to have a gripping means for removably connecting a top stabilizing plate directly to one of the "I"-shaped beams forming a mobile home chassis to form an integral unit therebetween so that the support system is integral with and supporting the mobile home. Further, the gripping means can be easily removed from clamping relationship with the "I"-shaped beam forming the chassis by means of loosening the connecting means such as stress bolts.

BRIEF DESCRIPTION OF THE DRAWING

These and other advantages of the present invention will become more apparent when considered in light of the detailed description hereafter of the preferred embodiment which includes the following figures.

DESCRIPTION OF THE PREFERRED EMBODIMENT

Figure 1:
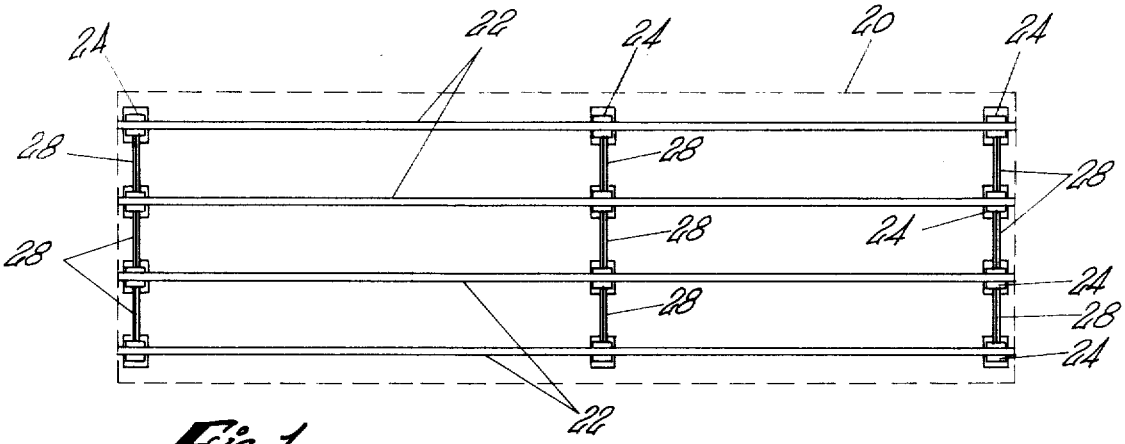
FIG. 1 is a top plan view of a chassis of a mobile home formed of a plurality of spaced, parallel support beams having bottom flanges and which is supported at certain points thereof by a plurality of support member assemblies.

The top plan view of FIG. 1 shows a mobile home which is represented by dashed lines 20 having a chassis formed of a plurality of spaced, parallel "I"-shaped beams 22. The mobile home and its chassis is supported by a plurality of support member assemblies 24 which are located at each end of the mobile home and at the center thereof. The support member assemblies are interconnected by a plurality of sturt stabilizing rods 28. The support member assemblies are attached to the bottom flange of the support beams which have an "I"-shaped cross section 22 to form an integral assembly therewith.

Figure 2:
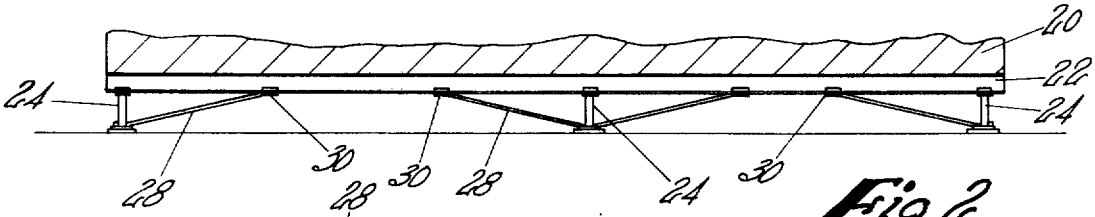
FIG. 2 is a partial side plan view of a mobile home having one of the spaced, parrallel support beams having an "I"-shaped cross section shown along the edge thereof which is attached to and supported by a plurality of support member assemblies disclosed herein.

The partial side plan view shows the mobile home 20 and one of the spaced, parallel "I"-shaped beams 22 in greater detail. In a typical installation, support member assemblies are located at each end of the mobile home and at the center thereof. As shown in FIG. 1, a double wide mobile home having an exterior dimension of 24 ft.×60 ft. formed of two 12 ft.×60 ft. sections could have 12 support member assemblies located four at each end and four at the center thereof. Each support member assembly 24 is connected to a strut stabilizing rod 28. Along the side of the mobile home, one end of the strut stabilizing rod is connected to a strut stabilizing rod connecting member 30. In a typical mobile home installation, a strut stabilizing rod 28 is connected to spaced intermediate strut stabilizing rod connecting members 30 as shown in FIG. 2.

Figure 3:
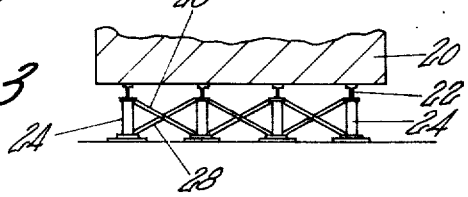
FIG. 3 is a partial end plan view of a mobile home having a chassis formed of a plurality of spaced, parallel support beams which is interconnected to four support member assemblies and a plurality of strut stabilizing rods interconnected to form a support system.

FIG. 3 shows in greater detail the interconnection relationship between a plurality of support member assemblies 24 and a plurality of strut stabilizing rods 28. In a typical mobile home installation, four support member assemblies are located along the end of the mobile home and are clamped to and support the spaced, parallel "I"-shaped beams 22. As shown in FIG. 3, the strut stabilizing rod connecting members 28 are connected in an "X" mark type arrangement. One end of a strut stabilizing rod is connected to a bottom tab extending from the planar base forming part of a support member assembly 24 and the other end thereof is connected to an aligned tab 44 extending from the top member of a support member assembly 24.

Figure 4:
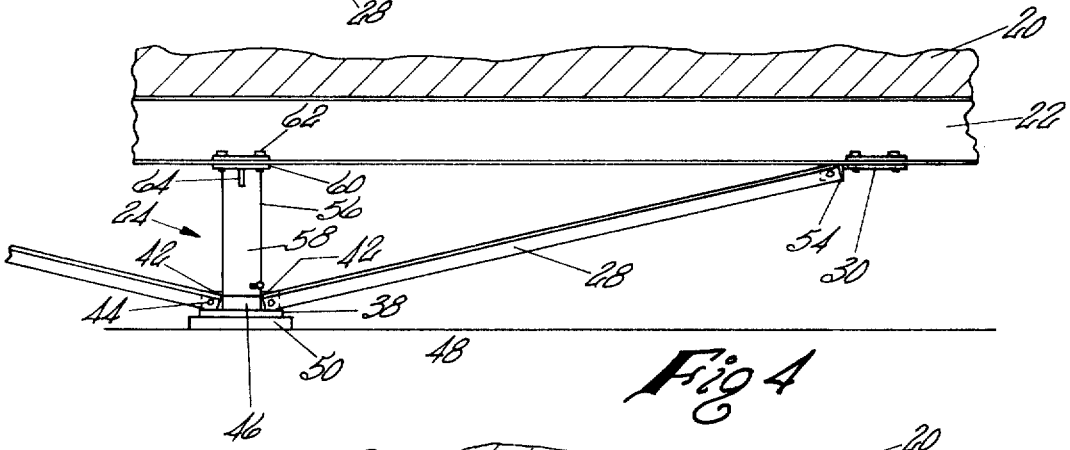
FIG. 4 is a detailed partial side plan view of a mobile home having a plurality of spaced, parallel support "I"-shaped beams showing in detail the relationship between the support member assemblies, top members, a plurality of strut stabilizing rods and a strut stabilizing rod connecting means.

FIG. 4 shows in greater detail the relationship between the various components of a support member assembly 24, strut stabilizing rod 28 and a strut stabilizing rod connector assembly 30.

Figure 6:
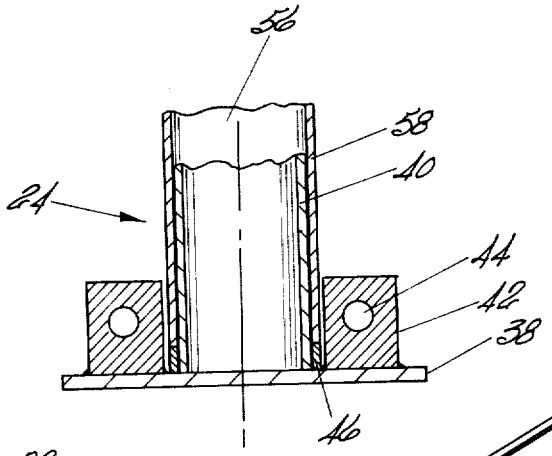
FIG. 6 is a partial cross section of a support member assembly showing the planar base, vertically extending portion and aligned base tabs.

Each support member assembly 24 includes a planar base 38, vertically extending portion 40, as shown in FIG. 6, and at least one pair of aligned base tabs 42.

The vertically extending portion 40 has a selected external geometrical dimension and shape such as, for example, a circular cross-sectional area having a hollowed out central area. At least one pair of aligned base tabs 42 are positioned one on each side of the vertically extending portion 40 and spaced a predetermined distance from the exterior thereof. Each of the aligned base tab members 42 includes means for defining an aperture therein, such as aperture 44, which has an axis which is substantially parallel to the planar base 38.

Each support member assembly 24 includes a height adjustment ring 46 which has an internal dimension and shape to enable the ring member 46 to be positioned circumferentially around the exterior of the vertically extending portion 40. The ring 46 has a wall thickness slightly less than the predetermined distance between the ends of the aligned base tabs 42 and the exterior periphery of the vertically extending portion 40. Each of the rings 46 has a preselected axial length which is determined by the additional spacing that is required between the lower flange of "I"-shaped beam 22 and the ground depicted by numeral 48. In a typical installation, the planar base 38, which supports the entire support member assembly 24, is mounted on a treated wood support, such as, for example, a piece of pine or fir depicted by block 50. Alternatively, the adjusting ring 46 may be eliminated by use of a top member having a lower extended portion 40 of exact length.

Strut stabilizing rod 28 has one end thereof connected to one of the aligned base tabs 42 with the other end thereof connected to the strut stabilizing rod connector member 30. Connecting means such as, for example, stress bolts, are used to connect both ends of the strut stabilizing rods to the aligned tabs 42 affixed to the planar base 38 and to extended tab 54 located on strut stabilizing rod connecting member 30.

Each support member assembly 24 includes a top member generally shown as 56. Top member 56 has an extended lower portion 58 which is formed of an internal geometrical dimension and shape to receive and slide over the vertically extending portion 40 of the support member assembly. The top member includes a stabilizing plate 60 and a gripping means 62 which is shown is greater detail in FIG. 7. In addition, the stabilizing plate 60 has at least one pair of aligned top tabs 64 positioned in spaced parallel alignment with at least one set of base tabs 44. Each of the top tabs 64 includes means for defining an aperture therein which has an axis which is substantially parallel to the planar base 38 and the axis of the base tabs 42.

As noted above, FIG. 4 is a typical installation as viewed from the side of a mobile home.

Figure 5:
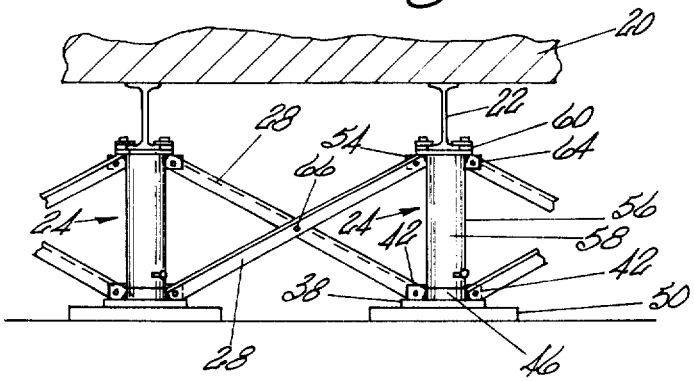
FIG. 5 is a detailed end partial plan view showing the relationship between the mobile home, the parallel "I"-shaped beams forming the chassis, and the relationship between the support member assemblies and the strut stabilizing rods interconnected the same as used at the ends of a mobile home.

FIG. 5 illustrates in greater detail the interrelationship between the support member assemblies 24, the strut stabilizing rods 28 and the "I"-shaped beams 22 of a mobile home. In the front view of the support system illustrated in FIG. 5, a pair of support member assemblies 24 are illustrated in an "X"-shaped arrangement. Each support member assembly 24 is attached to the lower flange of "I"-shaped beam 22 which forms a chassis of the mobile home. Each support member assembly 24 has a bottom portion 40, a top member 56 in a ring 46. The stabilizing plate 60 is affixed to the lower flange of "I"-shaped beam 22 by means of a gripping means, wherein the gripping force is obtained by use of stress bolt and nut assembly. The stabilizing plate 60 together with the gripping means forms an integral unit. Thus, movement of the mobile home together with the chassis results in relative movement between the planar base 38 and the wood block 50. The "X" arrangement formed by the strut stabilizing rods 28 is joined at the center by means of a fastener 66.

FIG. 6 shows in greater detail the details in construction of a support member assembly 24. The support member assembly 24 has a base support member formed of a planar base 38 which has the vertically extending portion 40 extending therefrom. In the preferred embodiment, the planar base 38 and the vertically extending support member 40 are formed of metal. The vertically extending portion 40 is either welded to or cast integrally with the planar base 38. In the preferred embodiment, the cross section of the vertically extending portion 40 is a thin walled cylinder having a hollowed out central area. The aligned base tab 42 is spaced a predetermined distance from the exterior surface of the vertically extending portion 40. The predetermined distance is sufficient and approximates the width of the ring 46. The bottom tab 42, in the preferred embodiment, is either welded to or cast with the planar base 38.

Figure 7:
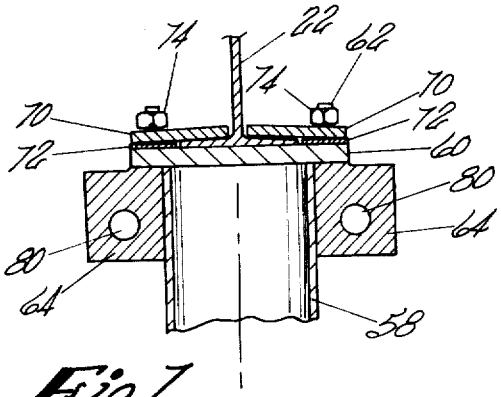
FIG. 7 is a partial cross-sectional view showing a top member having an extended lower portion and a stabilizing plate including gripping means for connecting the top member to the bottom flange of an "I"-shaped beam.

The top member has an extended lower portion 58 formed to have an internal geometrical dimension and shape to receive and slide over the vertically extending portion 40. In the preferred embodiment, the extended lower portion of the top member is formed into a thin wall cylinder having a hollowed out central area. The thickness of the extended lower portion 58 is approximately equal to the thickness of the height adjustment ring 46. The distance or space between the planar base 38 and the stabilizing plate 60 shown in FIG. 7 is determined or controlled by the length of the extended lower portion 58 and the axial length of the adjustment ring 46. The axial length of the vertically extending portion 40 is equal to or less than the length of the extended lower portion 58.

FIG. 7 illustrates the construction of the top member and of the gripping means. The top member includes the extending lower portion 58 which is attached to and extends from the stabilizing plate 60. In the preferred embodiment, the extending lower portion 58 and the stabilizing plate 60 are formed of metal and the extending lower portion 58 is either welded to or cast integral with the stabilizing plate 60. The gripping means comprises a top gripping plate 70, a top gripping spacer 72 and a fastening means, such as a stress bolt and nut assembly 74. The lower flange of "I"-shaped beam 22 has a slight angular taper as illustrated in FIG. 7.

The top gripping spacer 72 is selected to have a length approximately equal to the width of the flange of "I"-shaped beam 22. The top gripping plate 70 is adapted to have one edge thereof engage the flange on the "I"-shaped beam 22 and the other edge thereof in contact with the top gripping spacer 72. The top gripping plate 70 cooperates with the top gripping spacer 72 so that a slight angular disposition occurs between the top gripping plate 70 and the bottom of the "I"-shaped beam 22. By use of stress bolts and nuts and spacer, the top gripping plate 70 exerts a rigid clamping force which secures the "I"-shaped beam 22 against the stabilizing plate 60 forming an integral assembly therebetween. Stress bolts and nuts should be able to withstand a torque of between 300 ft. lbs. to 400 ft. lbs.

In one embodiment, a two (2) inch by six (6) inch steel plate having a thickness of ½ inch was utilized as the top gripping plate 70. Four (4) ¾ inch stress bolts and nuts were utilized and were torqued to 355 foot lbs. The top gripping plate assembly was then subjected to a load to determine what pound force level would cause slippage between the steel top gripping plate 70 and the "I"-shaped beam 22. The initial friction loss occurred at approximately 16,000 lbs. of force. Once the original friction was overcome, approximately 13,500 lbs. of force was required to continue the slippage. During the test of the slippage forces, the bearing friction surface was limited to the edge of the plate in contact with the web of the "I"-shaped beam 22. The torquing of the bolts caused a tight integral support to occur between the edges of the top gripping plate 70 and the stabilizing plate 60.

A similar test arrangement was conducted which subjected the support member assembly to vertical load testing. The test included measuring the yield load; that is, the load at which the support member assembly 24 started to deform in response to a vertical load. Typically, a support member assembly 24 is painted to provide good aesthetic appearance. When a painted support member assembly is subjected to a vertical load, the result is that certain areas of the paint spall off of the lower extended portion 58. In addition, the support member assembly 24 was subjected to an ultimate load test; that is, the maximum load where continued loading caused more deformation of the support member assembly 24 with no increase in loading. The test results for three (3) tests were as follows:

| Test No. | Yield Load (Pounds) | Ultimate Load (Pounds) |
|---|---|---|
| 1 | 123,000 | 135,000 |
| 2 | 121,000 | 131,000 |
| 3 | 124,000 | 136,000 |

Figure 8:
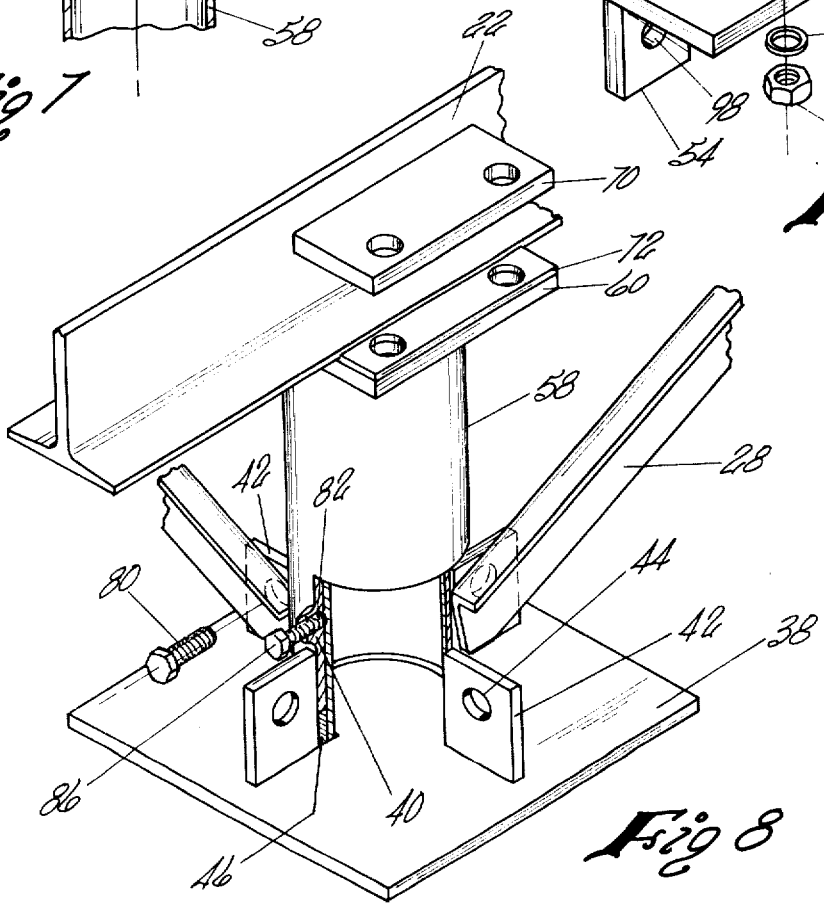
FIG. 8 is a partially cut-away perspective view of a support member assembly formed of a support member, an adjusting ring, a top member and means for connecting the strut stabilizing rods to the base tab members.

FIG. 8 shows in detail structural relationship existing between the various components of the support member having the planar base 38 formed with the vertically extending portion 40, the height adjustment ring 46 and the aligned base tab 42. The lower extending portion 58 which extends from the stabilizing plate 60 has an internal dimension and geometrical shape which is adapted to enable the lower extending portion 58 to slide over and intimately engage the exterior of the vertically extending portion 40 from the planar base 38. The edge of the lower extending portion 58 likewise engages with and is supported by the edge of the height adjustment ring 46. The lower extending portion 50 has an aperture 82 extending thereto which is threaded and adapted to receive a locking bolt 86. The locking bolt when tightened clamps the lower extending portion 58 to the vertically extending portion 40 such that relative movement therebetween will keep the support member assembly 24 together as an integral unit.

Figure 9:
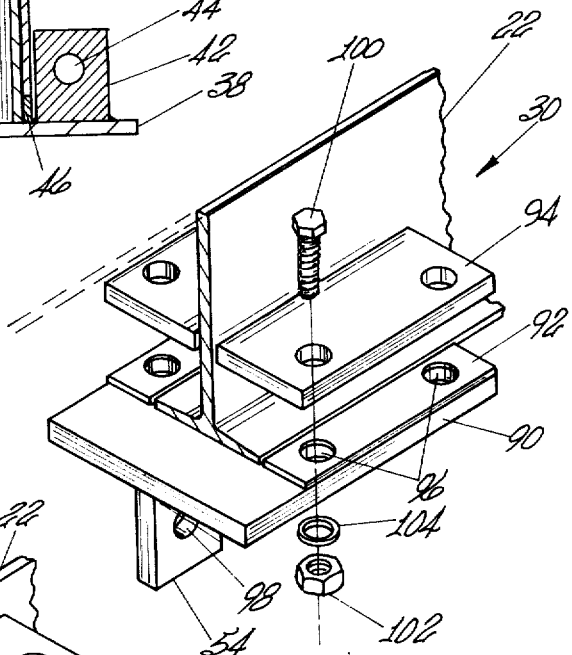
FIG. 9 is a partially exploded perspective view showing a strut stabilizing rod support member comprising a stabilizing plate and gripper means comprising a clamping plate, spacer plate and connecting means. The same numerals identify the same elements throughout all of the figures.

The stabilizing strut rods 28 are connected to the aligned base tabs 42 by fastening means such as, for example, a stress bolt 88 which is shown on FIG. 9.

The stabilizing plate 60 cooperates with the top gripping spacer 72 and the top gripping plate 70 in order to provide the clamping force to hold the stabilizing plate in a clamping relationship with the lower flange of "I"-shaped beam 22.

FIG. 9 shows, in greater detail, the structure and construction of the stabilizing rod connecting member shown generally as 30. The "I"-shaped beam 22 is adapted to cooperate with a strut stabilizing plate 90. A strut stabilizing spacer 92 cooperates with a strut stabilizing gripping plate 94 to form a clamping means which permits the strut stabilizing connecting member 30 to be connected to the "I"-shaped beam 22. A stress bolt 100 and the cooperating stress nut 102 and lock washer 104 is a fastening means which is adapted to provide the desired clamping force against the web of the "I"-shaped beam 22. The strut stabilizing plate 90, the strut stabilizing spacer 92, and the strut stabilizing gripping plate 94 all have an aperture extending therethrough designated by numeral 96 into which the bolt 100 is inserted.

Extending from the bottom of the strut stabilizing plate 90 is the alignment tab 54 which is adapted to cooperate with the end of a strut stabilizing rod 28.

The support system for a mobile home has several important advantages in utility. First, certain areas of the United States experience earthquakes which results in undulations and movement of the ground which supports the mobile home and a support system for the mobile home. The gripping clamping assembly which comprises the top gripping plate 70, the top gripping spacer 72 and the stress nut and bolt assembly 74, which form part of the support member assembly 24, and the strut stabilizing plate 90, strut stabilizing gripping spacer 92 and the strut stabilizing gripping plate 94, together with the stress bolts 100 and nut 102 and lock washer 104, which form the strut stabilizing rod connecting member 30, each function to clamp the support assembly directly to the "I"-shaped beams forming the chassis for the mobile home. When the support system for the mobile home and the mobile home is subjected to seismic waves that are generated during the earthquake, the entire support assembly can be subjected to a rolling wave of various amplitudes and frequency, which frequency is usually in the order of ten (10) cycles or less. The seismic waves cause one end or one side of the mobile home and the integral support system to be raised or lowered relative to the other portion. In such event, the support system and the mobile home together form an integral unit such that any relative movement will occur only between the earth, the woodblock 50 and the planar base 38. Although the mobile home would be shifted off the wood support 50 and possibly moved relative to its permanent location, at all times during movement of the support system and mobile home in response to a seismic wave generated during an earthquake, the entire unit will remain together as an integral unit. The large gripping forces which are provided by the various gripping plates and their associated components provide sufficient frictional clamping force to hold the support system to the "I"-shaped beam during a typical earthquake. Further, the large vertical load forces which the support assembly 24 can take far exceed any vertical load which would be created between the support member assembly 24 and the "I"-shaped beam 22 in that any vertical forces would result in the entire mobile home and support system moving together relative to a seismic wave.

When the support member assembly 24 is subjected to a seismic wave, additional stresses occur between each of the individual support assemblies along the end of the mobile home such that the strut stabilizing rods 28 serve to hold the entire support system together as an integral support system. Likewise, along the side of the mobile home, the strut stabilizing rod and connecting members 30 cooperate with the support member assembly 24 to which it is connected to hold the support member assembly 24 in a vertical rigid relationship relative to the "I"-shaped beam forming the chassis of the mobile home such that the entire support system and mobile home will respond to forces generated by a seismic wave to move relative to the undulating ground.

Further, in the event of relative movement between the mobile home 20 together with the attached rigid support system formed of the support member assemblies 24, strut stabilizing rods 28 and strut stabilizing rod connecting members 30, the chassis of the mobile home is continually supported at all times such that one end thereof does not lose vertical support during the crucial time and that any relative movement between the mobile home is limited solely to relative movement between the planar base 38 and the supportive ground. After the mobile home and support system is subjected to such seismic wave, it is a relatively easy procedure to readjust the support member assemblies 24 such that the mobile home can be relocated back on its foundation with very little damage.

One other utility of the support system is that all corners of the mobile home and the center thereof are continually supported by a uniform support of a predetermined height such that relative movement which occurs between the ground and the support system may shift the mobile home off of its permanent location such that one or more of the support assemblies' total height is not sufficient to enable support or contact with the ground. In such event, the remaining support member assemblies 24 afford sufficient support to insure that the entire chassis of the mobile is supported and not permitted to move a substantial distance relative to the supportive portions thereof.

What is claimed is:

1. A support system for a mobile home having a chassis formed of a plurality of spaced, parallel support beams having an "I"-shaped cross section which defines a bottom flange comprising a plurality of support member assemblies adapted to be positioned under said support beams, each of said support member assemblies including a planar base having a vertically extending portion of a selected length and a predetermined external dimension and shape and at least one pair of aligned base tabs positioned one on each side of and spaced from the exterior of the vertically extended portion of the base;

a height adjustment ring having an internal dimension and shape to enable the ring to be slideably positioned circumferentially around the exterior of the vertically extended portion of the base, said ring having a wall thickness slightly less than the space between the vertically extended portion of the base and the aligned base tabs, said ring member having a preselected axially extending length;

a top member having an extended lower portion having a maximum axial length equal to said selected length formed of an internal geometrical dimension and shaped to receive and slide over said vertically extending portion of the base and into contact with the edge of a said ring, said top member including a top stabilizing plate and gripping means adapted to fixedly attach said stabilizing plate to a bottom flange of a said one of the beams to be supported thereby, said stabilizing plate having at least one pair of aligned top tabs positioned one on each side of the lower extended portion of the top and positioned in spaced parallel alignment with said at least one set of base tabs;

at least two strut stabilizing rods each having one end extending from at least one of a selected one of the top tabs and a selected one of the bottom tabs; and means for fixedly connecting said one end of each stabilizing rod to at least one of a selected top tab and a selected bottom tab; and a strut stabilizing rod connecting member adapted to be attached to a bottom flange on one of said support beams and comprising a strut stabilizing plate;

a strut stabilizing gripper spacer positioned to engage the surface of said strut stabilizing plate adjacent a bottom flange on said one of a said support beam;

a strut stabilizing gripper plate adapted to have one edge thereof engage a bottom flange on said one of a said support beam and the other edge thereof in contact with said strut stabilizing gripper spacer; and means for providing a strut stabilizing clamping force between said strut stabilizing plate, said strut stabilizing gripper plate and said strut stabilizing gripper spacer urging said one edge of the strut stabilizing gripper plate into tight frictional engagement with a bottom flange on said one of a said support beam.

2. A support system for a mobile home having a chassis formed of a plurality of spaced, parallel support beams with a bottom flange comprising at least one support member assembly adapted to be positioned under one of a said beam including a planar base having a vertically extending portion of a selected length and a predetermined external dimension and shape and at least one pair of aligned base tabs positioned one on each side of and spaced from the exterior of the vertically extended portion of the base;

a top member having an extended lower portion formed of an internal goemetrical dimension and shaped to receive and slide over said vertically extending portion of the base, said top member including a top stabilizing plate and gripping means adapted to fixedly attach said stabilizing plate to a bottom flange of a said one of the beams to be supported thereby, said stabilizing plate having at least one pair of aligned top tabs positioned one on each side of the lower extended portion of the top and positioned in spaced parallel alignment with said at least one set of base tabs;

at least two strut stabilizing rods each having one end extending from at least one of a selected one of the top tabs and a selected one of the bottom tabs; and means for fixedly connecting said one end of each stabilizing rod to at least one of a selected top tab and a selected bottom tab.

3. The support system of claim 2 further comprising a height adjustment ring having an internal dimension and shape to enable the ring to be slideably positioned circumferentially around the exterior of the vertically extended portion of the base, said ring having a wall thickness slightly less than the space between the vertically extended portion of the base and the aligned base tabs, said ring member having a preselected axially extending length.

4. The support system of claim 3 wherein said fixedly connecting means comprises fastening means.

5. The support system of claim 4 wherein said fastening means comprises a stress bolt and stress nut assembly capable of withstanding a torque of at least 300 foot lbs.

6. The support system of claim 2 further comprising a strut stabilizing rod connecting member adapted to be attached to a bottom flange on one of said support beams and comprising a strut stabilizing plate;

a strut stabilizing gripper spacer positioned to engage the surface of said strut stabilizing plate adjacent a bottom flange on said one of a said support beam;

a strut stabilizing gripper plate adapted to have one edge thereof engage a bottom flange on said one of a said support beam and the other edge thereof in contact with said strut stabilizing gripper spacer; and means for providing a strut stabilizing clamping force between said strut stabilizing plate, said strut stabilizing gripper plate and said strut stabilizing gripper spacer urging said one edge of the strut stabilizing gripper plate into tight frictional engagement with a bottom flange on said one of a said support beam.

7. The support system of claim 6 wherein said strut stabilizing clamping force means is capable of producing an initial tight frictional clamping force between said one edge of the strut stabilizing gripper plate and a said bottom flange on said one of a support beam in the order of at least 16,000 lbs. and a continuing frictional clamping force in the order of at least 13,500 lbs.

8. The support system of claim 7 wherein said strut stabilizing clamping means includes a stress bolt and nut assembly capable of withstanding a torque of at least 300 foot lbs.

9. The support system of claim 2 further comprising a top member gripping means having a top gripper spacer positioned to engage the surface of the top stabilizing plate adjacent a bottom flange on said one of said support beams;

a top gripper plate adapted to have one edge thereof engage a said bottom flange on said one of said support beams and the other edge thereof in contact with said top gripper spacer; and means for providing a clamping force between said top stabilizing plate, said top gripper plate and said gripper spacer urging said one edge of the top gripper plate into tight frictional engagement with a said bottom flange on said one of said support beams.

10. The support system of claim 9 wherein said clamping force means is capable of producing an initial tight frictional clamping force between said one edge of the top gripper plate and a said bottom flange on said one of a said support beam in the order of at least about 16,000 lbs. and a continuing frictional clamping force in the order of at least about 13,500 lbs.

11. The support system of claim 10 wherein said clamping force means includes a stress bolt and nut assembly capable of withstanding a torque of at least 300 foot lbs.

12. The support system of claim 11 wherein said at least one support member assembly is capable of withstanding a vertical load of about 121,000 lbs. and an ultimate load of about 136,000 lbs.

* * * * *